United States Patent [19]

Jaenson

[11] 4,214,623

[45] Jul. 29, 1980

[54] METHOD FOR CONTINUOUS CASTING OF METAL

[75] Inventor: Howard W. Jaenson, Fullerton, Calif.

[73] Assignee: Witteman Steel Mills, Fontana, Calif.

[21] Appl. No.: 922,037

[22] Filed: Jul. 5, 1978

[51] Int. Cl.[2] ..... B22D 11/00; B22D 11/124

[52] U.S. Cl. ..... 164/83; 164/82

[58] Field of Search ..... 164/82, 83, 441, 442, 164/443, 447, 448

[56] References Cited

U.S. PATENT DOCUMENTS

| | | | |
|---|---|---|---|
| 648,091 | 4/1900 | Trotz | 164/441 |
| 1,088,171 | 2/1914 | Pehrson | 164/441 |
| 2,405,355 | 8/1946 | Harrison | 164/83 |
| 2,818,616 | 1/1958 | Rossi | 164/441 |
| 2,891,660 | 6/1959 | Honig | 266/139 X |
| 3,556,198 | 1/1971 | Nishovskikh | 164/83 |
| 3,556,198 | 1/1971 | Niskovskikh | 164/441 |
| 3,563,297 | 2/1971 | Wertli | 164/441 X |
| 3,708,010 | 1/1973 | Simons | 164/83 X |
| 3,752,220 | 8/1973 | Hofmann et al. | 164/442 |
| 3,882,924 | 5/1975 | Fujikawa | 164/441 |
| 4,088,179 | 5/1978 | Yabuki et al. | 164/441 |

FOREIGN PATENT DOCUMENTS 3221 of 1912 United Kingdom ..... 164/441

*Primary Examiner*—Robert D. Baldwin
*Assistant Examiner*—K. Y. Lin
*Attorney, Agent, or Firm*—Gene W. Arant

[57] ABSTRACT

In a steel mill operation, continuous casting of steel is accomplished by means of a vertically reciprocating mold that forms a billet or slab which progressively moved downward beneath the mold. A plurality of expansible metal shoes are provided, each of which can be selectively contracted for tightly squeezing the casting. The shoes are placed in sequentially spaced positions beneath the mold so that the casting passes through them. The shoes are selectively expanded and contracted, and are moved vertically, in conjunction with the reciprocating movement of the mold, in such manner as to mechanically support the casting and at the same time provide a longitudinal driving force for withdrawing it from the mold. Cooling liquid is continuously supplied to the shoes in order to withdraw heat from the molten metal in the interior of the casting. Whenever each shoe is contracted the resulting surface contact pressure against the casting results in an increased rate of withdrawal of heat.

10 Claims, 19 Drawing Figures

10
11
12
13
14
15
16
20
22
23
24
25
26
27
28a
28b
31
32
33
34
34a
34b
35
36
37
40
41
42
45
47
50

21
S
16
21b
21a
22
22a
22b
23a
60
23b
23
102
31
15
24
101
25
107a
40
107
32
100
105
50
26
42
62
33a
33
75
28a
41
14
27
62
28b
27a
41

15
14
60a
10
10
47
34c
34b
34a
45
32
42
34c
34b
34a
18
18
41
75
27a
80
31
33
40
107a
50
107
62
10
11
11
23a
105
28b
13
23
24
25
100
26
80
28a
27

24
25
31
32b
32a
102
101
103
108
109
109a
100
105
113
50
E1
E2
118
112
117
107
107a
105
33a
111
116
110
85
86
12
12
184a
184
185a
186a
186
50
185
184a,185a
186a
186
50
184,185
0°
5°
184a,185a
186a
186
186
50
184,185
5°

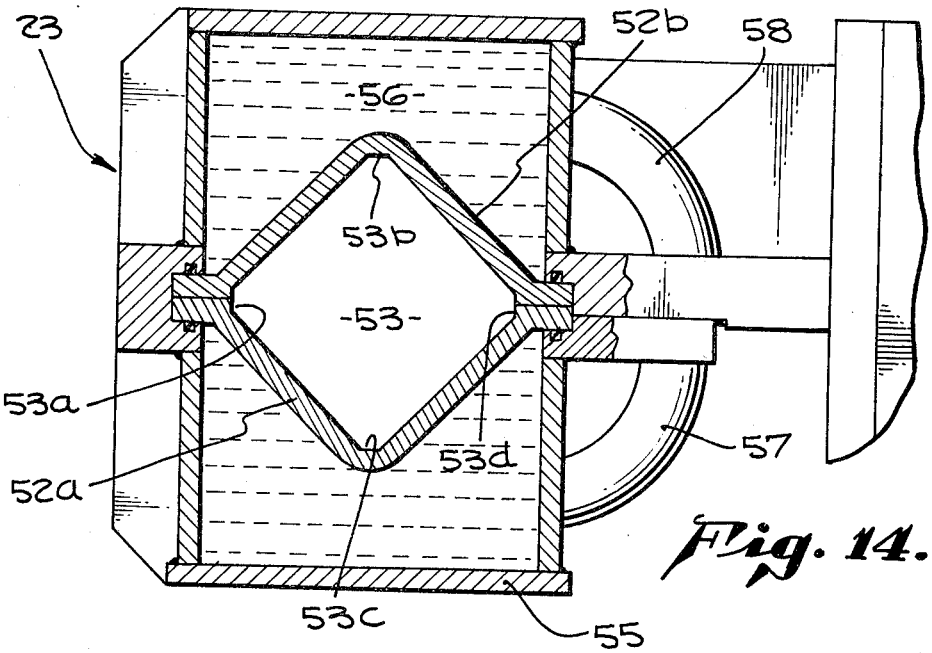
Fig. 14.
Fig. 17.
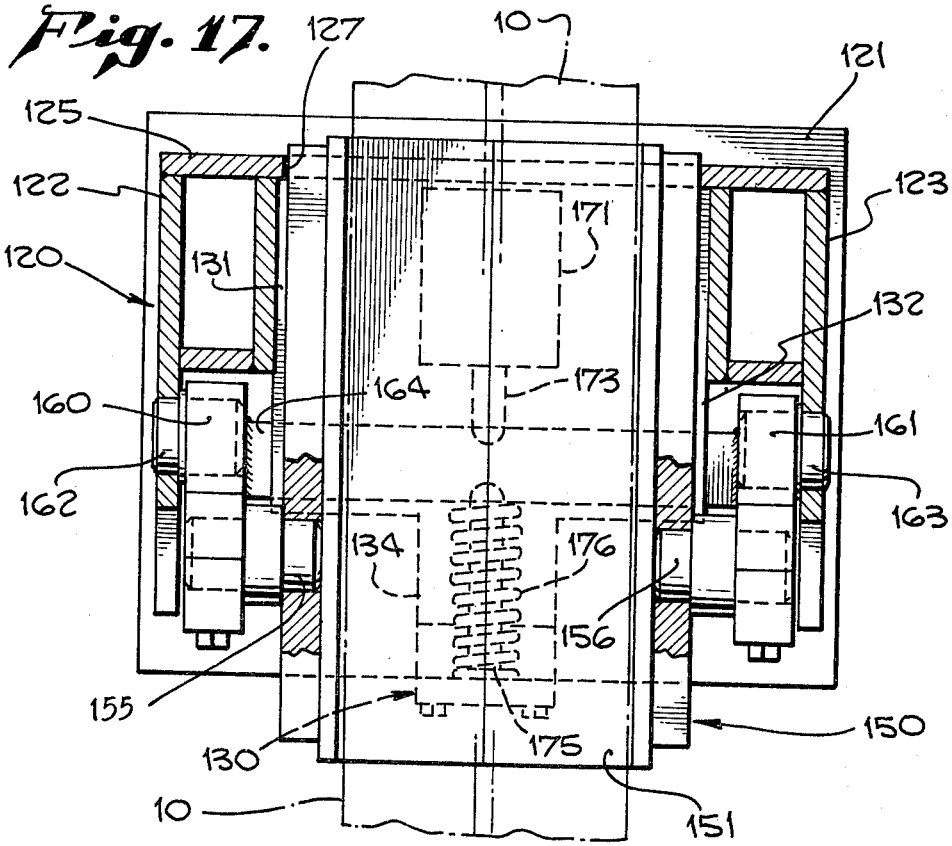

METHOD FOR CONTINUOUS CASTING OF METAL

BACKGROUND OF THE INVENTION

The present invention is directed to the continuous casting of metals, particularly in a steel mill operation.

By the year 1955 the continuous casting of steel, which in concept had been invented many years earlier, achieved a practical commercial form. This is evidenced by the article entitled "CONTINUOUS CASTING AT ATLAS STEELS, LTD.", by John F. Black and F. W. Rys, which appeared in the June, 1955 issue of IRON AND STEEL ENGINEER. An article entitled "CONTINUOUS CASTING OF STEEL" by Isaac Harter, Jr., was published in the April, 1956 issue of the same magazine. By 1964 at least sixteen other articles on this subject had been published in IRON AND STEEL ENGINEER.

Continuous casting produces a higher percentage yield of the metal than does the pouring of ingots. In terms of economics, the full advantage of continuous casting is achieved when the casting facilities are able to consume the entire contents of the melt furnace in a single cast.

It is inherent in the casting operation that initially it is only the outer surface of the metal which freezes into the cross-sectional configuration established by the mold. As the metal leaves the mold it consists of a thin exterior shell that is filled with a still molten interior. As the metal moves further away from the mold it must be progressively cooled until it is completely solidified. Mechanical support during the cooling process is a problem of some magnitude because, first, if the thin shell were to break open the molten metal in the interior would run out, and second, the static pressure of the molten interior portion of the metal continues to increase as it moves progressively further downward from the mold. Yet a further complicating factor is that excessive cooling will adversely affect the metallurgical characteristics of the resulting semi-finished metal.

It has been the accepted practice to employ guide rollers for guiding the casting along a desired pathway after it leaves the mold. The usual practice is to first guide the casting in a straight downward direction and then through a curved path of about 90 degrees until it arrives at a horizontal trajectory. Spray nozzles are positioned underneath the mold and are utilized to continuously spray water on the casting as it moves downward. The locations and design of the spray nozzles are carefully selected in order to achieve a desired cooling action. But the mechanical drive for withdrawing the casting from the mold is not accomplished either by the mold, by the guide rollers, or by the spray nozzles. This is left to another mechanism which is positioned many feet below the pouring ladle that initially furnished the molten metal to the mold, in the region where the horizontal trajectory has been reached. This mechanism conventionally takes the form of a number of pinch rollers which pull the casting horizontally away from the mold location.

One object of the invention is to provide a new and improved method for continuous casting of metal, particularly steel.

Another object of the invention is to provide an improved casting machine for the continuous casting of metals, which is far simpler and far less expensive than similar machines heretofore in use.

A further object of the invention is to provide novel specific mechanisms which may be advantageously used in continuous casting operations.

SUMMARY OF THE INVENTION

According to one principal feature of the invention the casting is positively withdrawn from the mold by means of expansible metal shoes that are positioned a relatively short distance beneath the mold, in lieu of remotely located pinch rollers.

According to another principal feature of the invention the same expansible metal shoes are utilized to cool the casting at a faster rate than is possible through the use of conventional cooling sprays. The faster rate of heat transfer is made possible by a surface-to-surface metal contact under pressure.

Still another principal feature of the invention is the use of the metal shoes to provide a firm mechanical support for the outer shell of the casting while its molten interior is still being cooled prior to solidification.

Another significant feature of the invention is the provision of a mechanical shoe structure that includes a relatively stationary part and a relatively movable part, the relatively stationary part being positioned on the outer radius of the casting to guide its path of longitudinal movement, and the relatively movable part being on the interior radius of the casting and adapted to be selectively pressed towards the stationary part in order to squeeze the casting therebetween.

An additional feature of the invention is the provision of an expansible metal shoe whose interior surfaces are curved in a longitudinal direction so as to fit about a continuous casting while it is moving through the curved portion of its trajectory.

A still further feature of the invention is the provision of hydraulic drive means for selectively expanding or contracting the expansible shoes.

Another feature of the invention is the withdrawal of the casting from the mold in a step-wise rather than continuous movement.

A further feature of the invention is the provision of a novel dummy bar together with its freeze plate, guide, drive, and release apparatus.

Yet another feature of the invention is the method of forming a billet of substantially square cross-sectional configuration in which the billet, rather than being bent along two of its flat sides, is bent along the diagonal plane between two of its diagonally opposite corners.

Yet a further feature of the invention is the method of forming a substantially square billet in which the mold is shaped with filled-in corners so as to provide relatively small flat sections where the corners of the billet would otherwise be formed, and the billet is subsequently handled on apparatus which does not directly engage or support the corner flats.

Still another feature of the invention is the specific design of an expansible metal shoe, and its associated cooling means and hydraulic drive means, for selectively squeezing a metal billet.

According to the presently preferred method and apparatus of the invention three expansible metal shoes, which may be of identical construction, are utilized to support the billet underneath the mold. A first shoe is physically attached to the mold and reciprocates vertically with it. A second shoe is spaced vertically below the first shoe and reciprocates in a vertical direction in time synchronism with the mold and first shoe; however, the mold and first shoe are programmed to travel a somewhat greater distance than the second shoe, thereby achieving a negative stripping action in the mold. A third shoe, spaced vertically beneath the second one, is more properly called a brake because it is used to perform a braking function. The brake squeezes the billet and holds it in place whenever the mold and first and second shoes are being moved upward, but releases its grip during their downward movement.

Further according to the presently preferred form of the invention, a water spray is used to cool the billet between the second shoe and the brake, since the spacing between these two devices is sufficient to permit that.

DRAWING SUMMARY

FIG. 14 is a horizontal cross-sectional view of the mold showing its interior construction;

FIG. 17 is a vertical cross-sectional view of the shoe taken on line 17—17 of FIG. 15;

PREFERRED EMBODIMENT

Reference is now made to the drawings, FIGS. 1 to 19, inclusive, which illustrate the presently preferred form of the method and apparatus of the present invention. In the illustrated embodiment the invention is applied to the continuous casting of steel.

Figures 1, 18, 19:
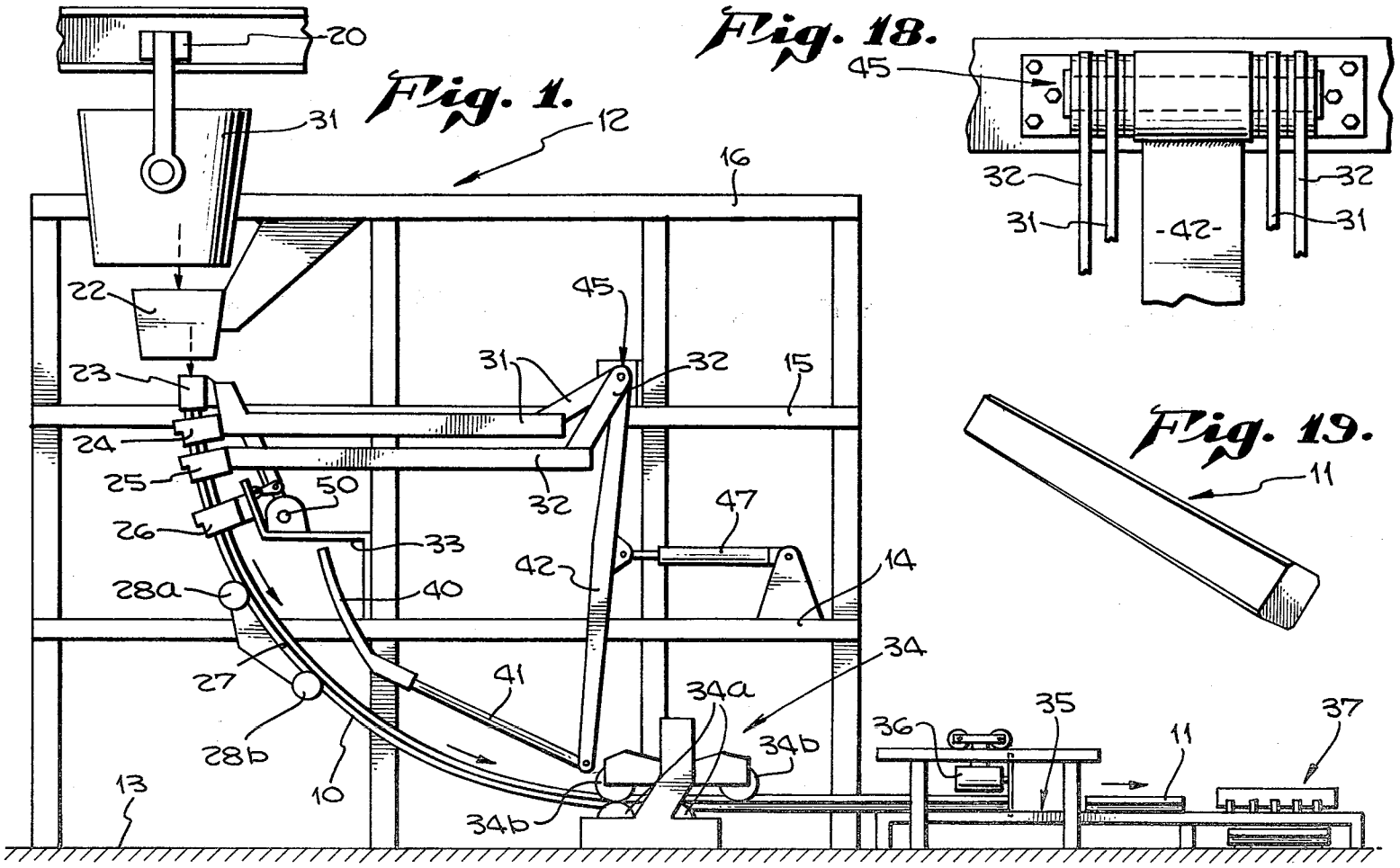
FIG. 1 is a schematic side elevation view of the continuous casting apparatus of the present invention, shown during a continuous casting operation.
FIG. 18 is a top plan view of the pivot support for the actuating arms of the shoes and dummy bar.
FIG. 19 is a perspective view of a billet section that has been cut to length after the billet has solidified.

Reference is first made to the schematic illustration of FIG. 1. As there shown, a billet 10 that is initially formed in a mold 23 moves continuously away from the mold, as indicated by the arrows. The billet initially moves downward on a vertical path but then curves through an angle of about 90 degrees until eventually assuming a substantially horizontal trajectory at a location many feet beneath the elevation of the mold. More specifically, the casting apparatus is housed in a building 12 which includes a bottom or ground level floor 13, a second floor 14, a third floor 15, and a top floor 16. An overhead crane 20 which is positioned above the top floor 16 is utilized to transport a ladle 21 filled with molten metal from the melt furnace to the casting structure, where the ladle is then supported by independent support means, not shown, from the top floor 16 of the structure. A tundish 22 is positioned beneath the ladle, being rigidly supported from top floor 16 of the building 12. Mold 23 is positioned beneath the tundish and is supported from movable support arms 31. In conventional fashion, molten steel at a temperature level of about 2900 degrees Fahrenheit is poured from ladle 21 through a bottom pouring spout into the tundish 22, and hence through a bottom pouring spout of the tundish into the mold 23. The selection of alloys or impurities in the metal, the control of the temperature of the molten metal, the control of the slag to avoid its inclusion in the cast metal, and the control of the rate of flow of the metal into the mold, are all accomplished in conventional fashion.

The novelty of the present invention lies in the method of handling the metal billet after it leaves the mold, and the apparatus used for carrying out the method. Thus a first expansible metal shoe 24 is positioned a short distance beneath the mold and is fastened to the movable support arms 31 so that it will reciprocate up and down with the mold. A second expansible metal shoe 25 positioned a short distance below the first shoe is supported on separate support arms 32. At some further distance beneath the second shoe 25 there is a brake 26, which is also constructed in the form of an expansible shoe. A support frame 33 which rises up from second floor 14 of the building 12 provides a fixed support for the brake 26.

Shown in retracted position in FIG. 1 is a dummy bar 40, which is used only during the commencement or start up of the casting operation and is then withdrawn to its retracted position, as shown. At the rear of dummy bar 40 is a dummy bar extension 41, which in turn is pivotally attached to the lower end of dummy bar support arm 42. The support arms 31, support arms 32, and dummy bar support arm 42 are all supported from a common pivot shaft 45, which is best seen in FIG. 18 displayed on the same drawing page as FIG. 1. Although the ends of the support arms 31, 32 which are attached to the respective shoes 24, 25 reciprocate vertically, the magnitude of their movement is small compared to their respective lengths, hence the support arms are always in a substantially horizontal position as shown in FIG. 1. In the retracted position of dummy bar 40, as shown, its support arm 42 is nearly vertical, but this angular position changes by about 15 or 20 degrees when the dummy bar is in the start up position shown in FIG. 2. A horizontally extending hydraulic drive cylinder 47 supported above the second floor 14 of the building 12 is coupled to about a mid-point on the length of dummy bar support arm 42 and provides its driving power.

Also supported upon the support frame 33 is a main drive shaft 50 which extends transversely of the vertical plane through which the billet 10 makes its curved pathway. All of the controls for driving the mold, the shoes, and the brake are powered directly from the main drive shaft 50, as will be explained in greater detail in conjunction with later drawings.

Positioned some distance beneath the brake 26 and at about the middle of the curved pathway of the billet 10 is a dummy bar guide frame 27. This guide frame is equipped with guide rollers 28*a* on its upper end and with guide rollers 28*b* on its lower end. At the lower end of its curved trajectory the moving billet 10 passes through straightening rollers 34 whose function it is to remove the curvature from the billet so that it will thenceforth travel in a straight horizontal path. Thereafter the billet passes over the horizontal cutting table 35 where a traveling cutter 36 is stationed. There the billet is cut into predetermined sections such as the section 11 that is more clearly shown in FIG. 19. Thereafter the cut sections are handled by an automatic stacker 37. After cooling, they are transported elsewhere for further processing.

It may be noted that in accordance with the presently illustrated embodiment of the invention the billet 10 moves in a step-wise fashion. The traveling cutter 36 is automatically controlled so as to travel forward with the billet during the time that a cutting operation is being performed. Then it is detached from the section of the billet that has just been cut, and later reattaches itself to the succeeding portion of the billet in preparation for the next cut. The general arrangement of the traveling cutter and its mode of operation were previously known in the art.

While the construction of the shoes and brake and of the controls which actuate them are shown in considerable detail in subsequent figures of the drawings, it will nevertheless be helpful to briefly describe their operation in conjunction with the schematic illustration of FIG. 1.

The step-wise downward movement of billet 10 is controlled primarily by the second shoe 25. Shoe 25 is capable of being contracted so as to tightly squeeze the billet, or of being expanded so that it grasps the billet only very lightly. Shoe 25 also moves up and down in a vertical reciprocating movement that is driven from the main drive shaft 50. The operation of the second shoe 25 is such that at the end of its upward travel it contracts in order to squeeze the billet, then moves downward pulling the billet with it, and then releases its grasp in order to move upward in preparation for the next step of the longitudinal drive movement.

Mold 23 and first shoe 24, which are attached to each other through the medium of the support arms 31, reciprocate up and down in exact synchronism with the movement of the shoe 25. However, their magnitude of movement is somewhat greater than that of the shoe 25, thus achieving a negative stripping action within the mold. First shoe 24 also tightens its grip at the upper end of its stroke, and maintains a tight grip during downward movement, then releasing its grip on the billet while moving upward in preparation for a new driving stroke. The second shoe 25, however, grips the billet 10 far more tightly than the first shoe 24. Hence the driving movement is controlled primarily if not exclusively by shoe 25 while shoe 24 merely assists in that regard.

It should be noted that, as well known in the art and as shown in detail in later drawing figures, the billet 10 is not entirely solidified upon leaving the mold 23. It has a hard exterior shell with a molten metal interior. The farther the billet travels beneath the mold 23 the greater becomes the difference in elevation, and hence the greater becomes the level of ferrostatic pressure at the lower elevation. It is perhaps essential and certainly advisable that the gripping pressure of the lower shoe 25 be considerably greater than the gripping pressure of upper shoe 24 in order to properly contain and counteract this ferrostatic pressure level. Hence the stronger grip of lower shoe 25 not only prevents breakage of the billet at that location but also assures the dominance of shoe 25 over shoe 24 in driving the billet in its downward steps of movement.

The main function of brake 26 is to hold the billet in place while the mold and shoes are returning from their lower limit position to their upper limit position. Hence the gripping action of the brake is initiated when the mold and shoes are at their lower limit position and is relieved when they are at their upper limit position. Again, the gripping force of brake 26 is made great enough to counteract the ferrostatic pressure at its particular elevation, and hence is greater than the gripping pressure of the second shoe 25.

It will be noted from FIG. 1 that in passing through its curved trajectory the billet 10 bends through an angle of 90 degrees while passing along an arc of a circle of which the pivot shaft 45 is the radius center. The radius of curvature of the billet is about 20 feet. The shoes 24 and 25 and the brake 26 are appropriately curved so as to maintain the billet on this curved path, and the rollers 28*a*, 28*b* and 34 are also appropriately positioned for that purpose. Thus, though the support arms 31 and 32 are substantially horizontal, the manner of connection at their ends to the pivot shaft and to the shoes, respectively, is such that they effectively provide the same operational result as would be achieved by radially aligned support members.

Figure 2:
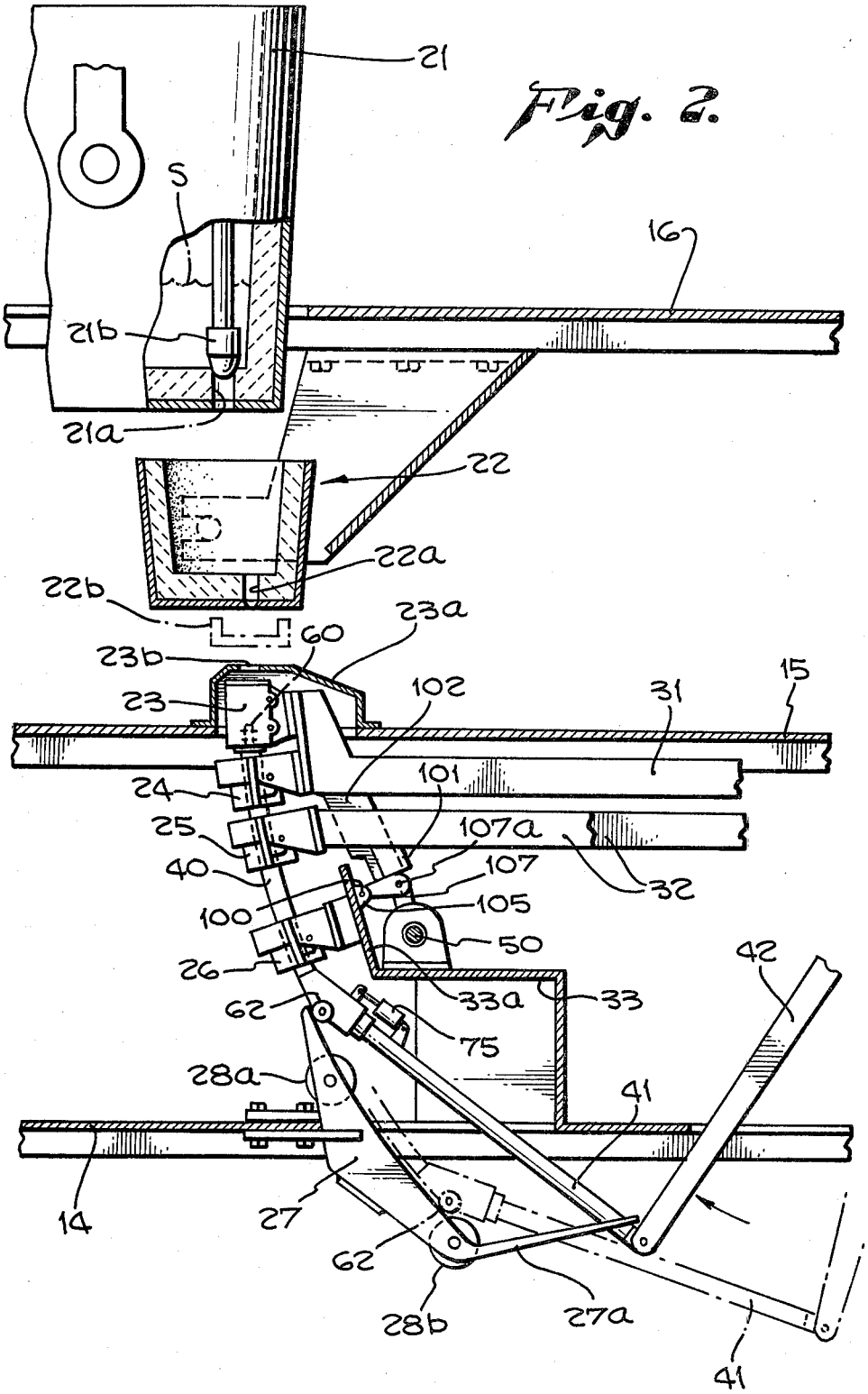
FIG. 2 is a side elevation view, partially in cross-section, showing the pouring ladle, the mold, the shoes and brake located beneath the mold, and also showing the dummy bar in a position ready for start-up of the casting operation.

FIGS. 2 through 5, inclusive, illustrate the startup of the continuous casting operation. Thus FIG. 2 shows molten steel S in the ladle 21, but which has not yet reached the pouring spout 21*a* because the spout is covered by a removable plug 21*b*. In the cross-sectional view of the tundish 22 its bottom pouring spout 22*a* is also seen, and immediately beneath it in dotted lines is shown a removable launder or tray 22*b* which is used to receive the initial flow of the metal and guide it away from the mold, but is then moved out of the way when the metal starts to flow in a steady and slag-free manner.

Also shown in FIG. 2 is a stationary housing 23*a* attached to the third floor 15 of building 12 and which covers the vertically reciprocating mold. Housing 23*a* has a central opening 23*b* through which the molten metal released from nozzle 22*a* may enter the mold.

Reference is also made at this time to FIG. 14 illustrating a horizontal cross-sectional view of the mold 23. In its interior the mold has a pair of angled copper plates 52*a*, 52*b* which are attached together at their meeting edges so as to provide a mold cavity 53 which is of substantially square configuration, with a width between flat surfaces which is presently 5¾ inches. However, the corners of the cavity are filled at 53*a, b, c, d,* to form relatively small corner flats. The copper plates 52 are supported in a housing 55 which in turn forms a cavity 56 that surrounds the copper plates. Water pipes 57 and 58 communicate with the cavity 56 in order to provide continuous circulation of cooling water along the external surfaces of the copper mold plates 52. The structure of the mold is believed to be in accordance with conventional concepts known in the art, except for the corner flats.

Figure 3:
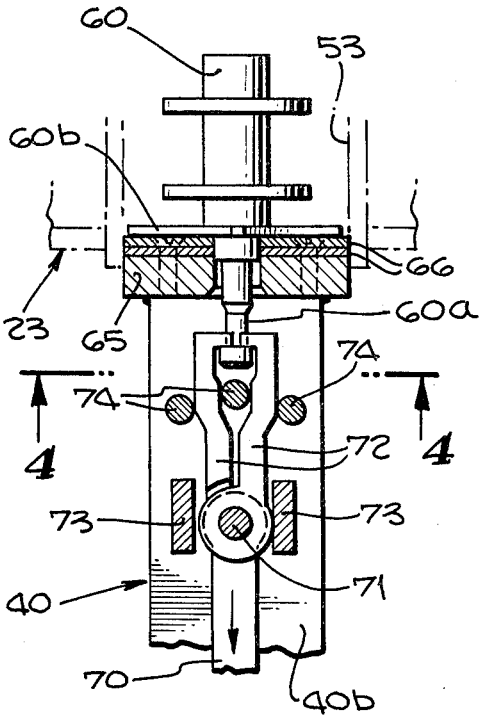
FIG. 3 is a detail view, partially in cross-section, of the mold and dummy bar taken in the starting position as shown in FIG. 2.
Figure 5:
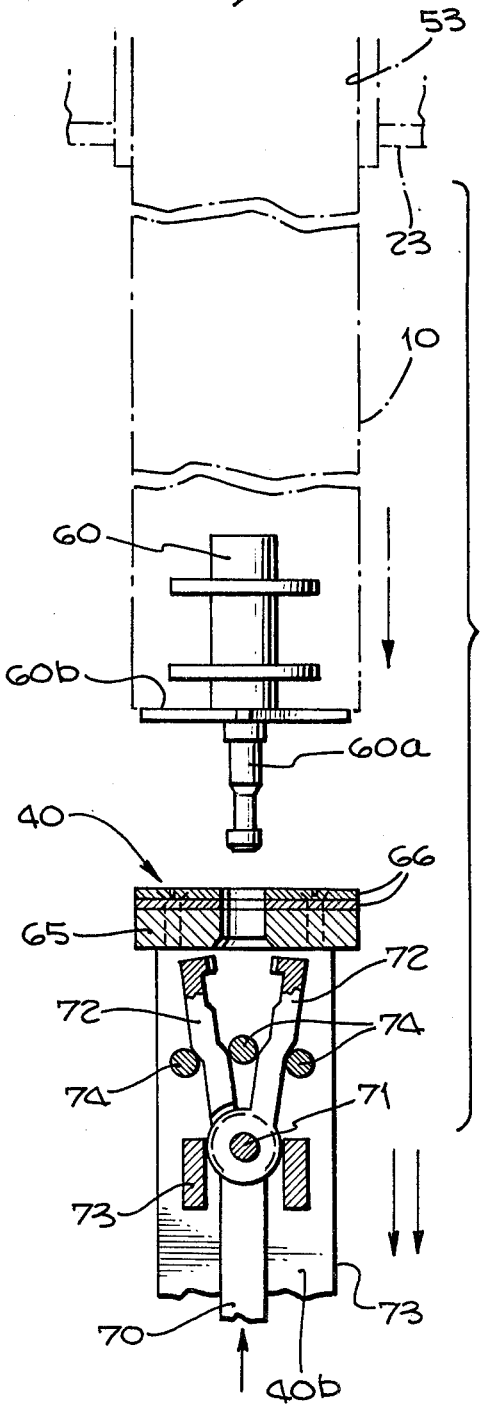
FIG. 5 is a plan view of the lower end of the billet after the casting operation has started, and also showing the end of the dummy bar separated from the freeze plate and billet.

To prepare for start up of the casting operation a freeze plate 60, FIGS. 3 and 5, is removably attached to the forward end of dummy bar 40 and then is inserted into the lower end portion of the mold cavity. Drive cylinder 47, FIG. 1, is actuated at this time for driving the dummy bar to the start up position. The positioning of the freeze plate inside the mold is also shown in FIG. 2.

Dummy bar 40 at its lower end is equipped with a pair of rollers 62, which ride on the dummy bar guide frame 27 on respective sides of the billet rollers 28*a*, 28*b*, respectively. At its lower end the guide frame 27 is equipped with a pair of forks 27*a* which extend upward at an angle of about 45 degrees to the billet trajectory at that point. Rollers 62 will cooperate with the forks 27*a* to retract the dummy bar out of the pathway of the billet, after the casting operation has been commenced and the billet has reached sufficient length. It is necessary that the billet pass through both of the shoes 24, 25 and also entirely through the brake 26 before the dummy bar is taken away. The length of the dummy bar, the location of rollers 62, and the location of forks 27*a* are suitably chosen to accomplish that purpose.

The apparatus for removably attaching the freeze plate 60 to the dummy bar 40 will now be described. Freeze plate 60 is equipped on its lower end with a center pin 60*a*, to which the dummy bar may be fastened. A steel head plate 65 is attached to the forward end of the dummy bar and its forward surface is covered by a pair of copper plates 66. These plates have a center opening through which the center pin 60*a* of the freeze plate 60 may enter. The dummy bar consists of a parallel pair of flat bars 40*a*, 40*b* seen in cross-section in FIG. 4, which are spaced apart to provide an internal cavity 67.

An actuating arm 70, FIGS. 3 and 5, is located within the hollow interior 67 of the dummy bar. At its forward end it is attached by means of a pivot pin 71 to a pair of jaws 72. These jaws are adapted to open and close within a plane that falls within the cavity 67. As shown in FIG. 3 when the jaws 72 are closed they capture the rearward end of the pin 60*a*. When they are in the open position as shown in FIG. 5 the pin 60*a* is released from their grasp. Guide members 73, FIGS. 3 and 5, serve to support the bars 40*a*, 40*b* in their spaced relation and also serve to provide a channel for the longitudinal reciprocating motion of the actuating arm 70 relative to the dummy bar 40. A set of three pins 74 are positioned forwardly of the guides 73 in the region that is also occupied by jaws 72. One pin is placed between the jaws and there is one pin on the outside of each jaw. The jaws are provided with bent portions so that when moved longitudinally they cooperate with the pins 74 to provide a camming action for opening or closing the jaws. Movement of actuating arm 70 to its forward position as shown in FIG. 5 causes the jaws to open while retraction of the actuating arm to the position shown in FIG. 3 causes the jaws to close.

Figure 4:
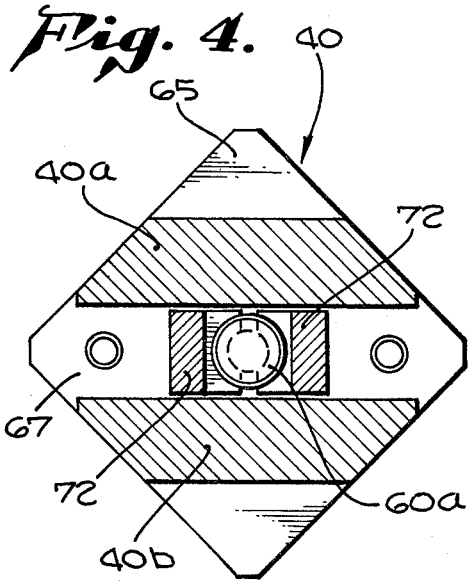
FIG. 4 is a cross-sectional view of the dummy bar taken on line 4—4 of FIG. 3.

As seen in FIG. 4 the dummy bar head 65 and covering plates 66 are made of square configuration with small corner flats, and are of such dimension as to fit suitably within the mold cavity 53 and to conform to its cross-sectional configuration. Copper plates 66 engage the base portion 60*b* of freeze plate 60 but without fusing or sticking to it. When the pouring of molten steel into the mold 23 is initially commenced the freeze plate 60 together with the head 65, 66 of the dummy bar serves as a plug for closing the lower end of the mold. Freeze plate 60 is of such volume and weight as to rapidly cool that portion of the molten metal which initially fills the lower end of the mold. Thus, there is rather immediate solidification of the leading end of the billet 10 even though the succeeding portion of the billet is solidified only at its outer surface.

Since the freeze plate 60 is firmly secured within the end of the billet and the dummy bar is in turn secured to the freeze plate by means of the jaws 72, lower shoe 25 by squeezing the dummy bar draws it downward along with the newly formed billet. Even though the bars 40*a*, 40*b* of the dummy bar do not constitute the full cross-sectional configuration of the billet itself (FIG. 4) they are nevertheless capable of being grasped by the same squeezing action of the shoe 25 that is effective for grasping the billet. Therefore, during the start up operation the dummy bar effectively acts as an extension of the billet for purpose of utilizing the manipulating capabilities of the shoes and the brake.

Once the billet itself enters the brake the dummy bar is no longer needed. In FIG. 2 the dummy bar is shown in dotted lines just after it has passed through the brake. At this time a cylinder 75 carried on the lower end of the dummy bar (FIG. 2) acts to drive the actuating arm 70 upward and thereby release the dummy bar from the freeze plate 60. At this time also the drive cylinder 47 for the dummy bar support arm 42 is energized in a reverse direction so as to propel the dummy bar downwardly at a far more rapid rate than the billet is traveling. Typically, the dummy bar moves at about five times the rate of the billet. Rollers 62 cooperating with forks 27*a* lift the dummy bar out of the path of the billet and into its fully retracted position as shown in FIG. 1.

FIGS. 6 through 11, inclusive, illustrate in greater detail the novel portions of the apparatus which were initially described in an outline form in conjunction with FIG. 1.

Figure 6:
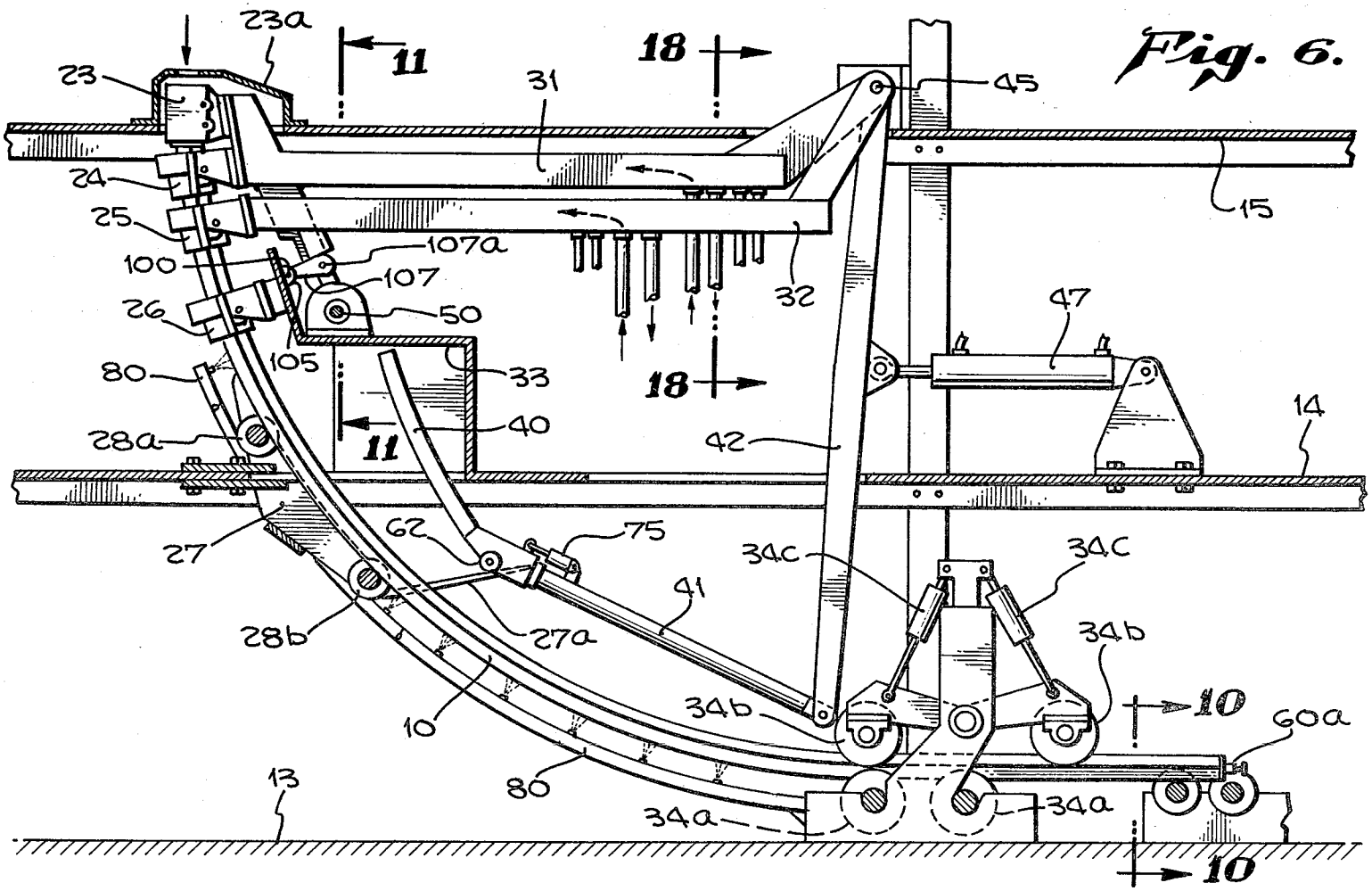
FIG. 6 is a view similar to FIG. 1, but on an enlarged scale, and showing more details of the various mechanisms for guiding and driving the billet and the dummy bar.

Thus for example it is shown in FIG. 6 that straightening rollers 34 include two pairs of lower rollers 34*a*, two pairs of upper rollers 34*b*, and a pair of drive cylinders 34*c* which control the positioning of respective ones of the upper rollers. The upper rollers are initially in somewhat raised positions when the leading edge of the billet reaches them, but they are then pushed down by their respective drive cylinders so as to straighten out the leading portion of the billet, and are maintained in this pinched condition so as to continuously straighten the succeeding portions of the billet.

Also seen in FIG. 6 are a long series of water spray nozzles 80 which are located on the exterior bending surface of the billet, commencing just below the brake 26 and extending to the location of the straightening rollers 34. In the further enlarged view shown in FIG. 7 there are also seen additional water spray nozzles 81 which are positioned between the second shoe 25 and the brake 26, including spray nozzles 81*a* located on the inside of the bend and spray nozzles 81*b* located on the outside. It will be understood that both the structure and function of these water spray nozzles are generally in accordance with the heretofore accepted practice in the art.

Figure 8:
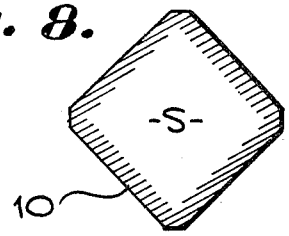
FIG. 8 is a cross-sectional view of the billet taken on the line 8—8 of FIG. 7.
Figure 9:
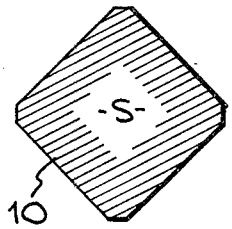
FIG. 9 is a cross-sectional view of the billet taken on line 9—9 of FIG. 7.
Figure 10:
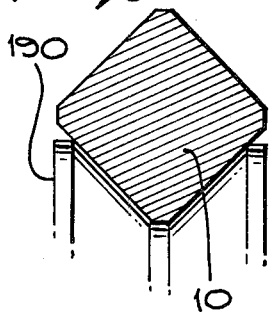
FIG. 10 is a cross-sectional view of the billet taken on the line 10—10 of FIG. 6.

FIGS. 8, 9 and 10 are cross-sectional views of the billet taken at successive points along its length, and illustrate the progressive cooling and solidification of the metal. Thus immediately after leaving the mold, as shown in FIG. 8, the billet 10 has a rather thin outer wall that is fully hardened while a much larger interior portion of its cross-sectional area is still in the form of molten steel S. After passing through both of the shoes and also the brake, however, the molten core section S of the billet is much smaller as shown in FIG. 9. Finally, FIG. 10 taken just beyond the straightening rollers 34 shows the entire cross-sectional area of the billet 10 has become solidified.

Figure 7:
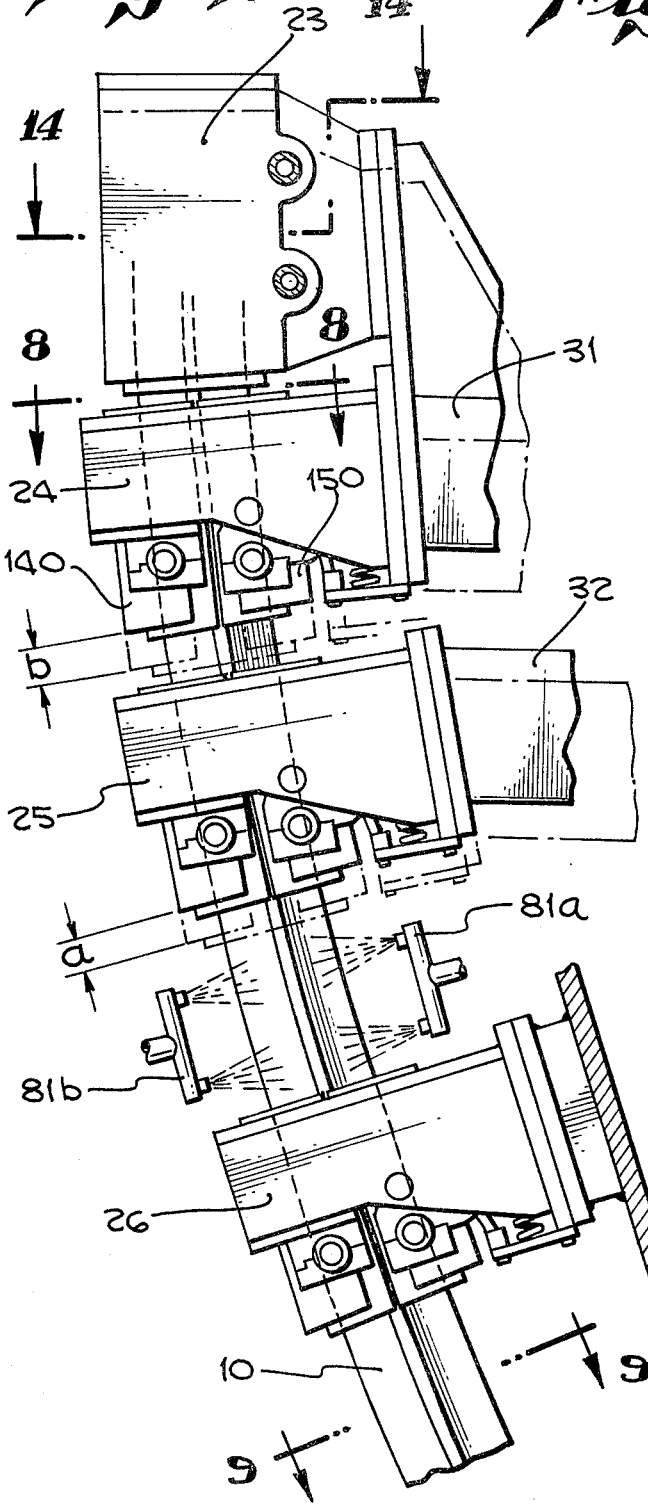
FIG. 7 is a further enlarged elevation view of the mold, shoes, and brake, and also showing the metal billet passing through them.

FIG. 7 shows in greater detail the structural configuration of mold 23, shoes 24 and 25, and brake 26. The interior construction of mold 23 is shown in FIG. 14, taken on line 14—14 of FIG. 7, and previously described. The shoes 24, 25 and the brake 26 are all of identical construction. However, each is controlled in a unique manner and operates differently from the others.

Figures 11, 12, 13:
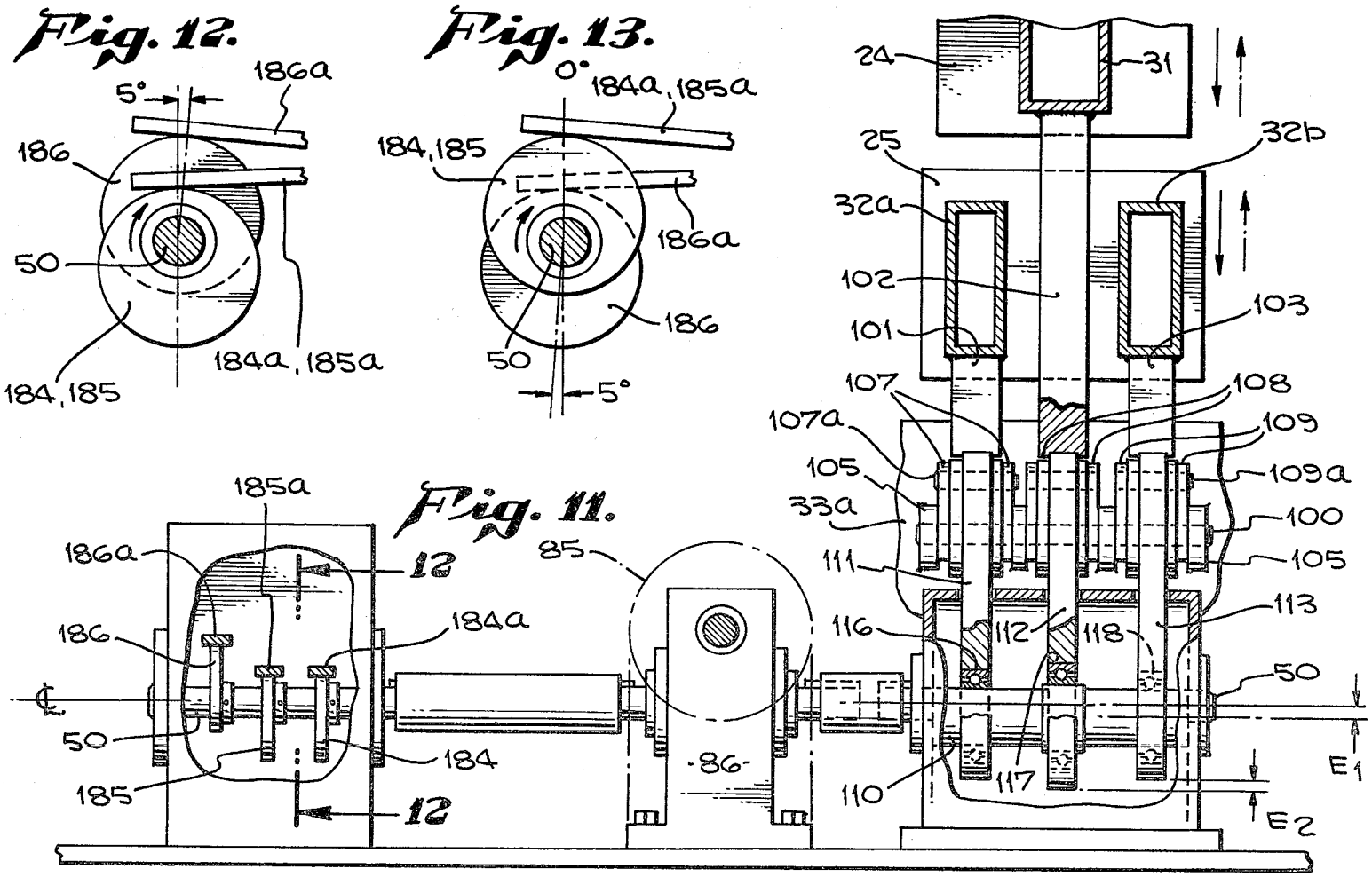
FIG. 11 is an elevation view, partially in cross-section, of the central drive system that controls both the vertical movements of the mold and the shoes and also the squeezing and expanding movements of the shoes and the brake, and is taken on line 11—11 of FIG. 6.
FIG. 12 is a detail view of the cams for controlling the squeezing and expanding movements of the brake and shoes, at one particular point in their operation.
FIG. 13 is a detail view of the brake and shoe cams at another point in their operation.

FIG. 11, which is taken on line 11—11 of FIG. 6, illustrates the central drive and control apparatus for the casting machine. A motor 85, shown in dotted lines, drives a gear box 86 which in turn drives the main drive shaft 50. The gear ratio of the gear box may be adjusted for changing the speed of the machine. It will be noted that the rate of flow of molten metal, and the rate of operation of the casting machine must be controlled in an absolute sense as well as relative to each other. For purposes of the present invention these controls may be carried out in the same manner as heretofore known in the art.

As the invention is presently practiced, an operator stationed near to the ladle controls the rate of flow of the liquid metal by controlling the level of liquid metal in the tundish. Then the speed of rotation of main drive shaft 50 is adjusted to conform to the rate of flow of the metal.

The main drive and control apparatus shown in FIGS. 11–13 controls both the vertical reciprocating movements of the mold and the shoes and also the contracting and expanding (or squeezing and opening) movements of the shoes and the brake. Vertical movements of the mold and the shoes are controlled mechanically, by apparatus shown on the right hand side of FIG. 11. Squeezing and opening movement of the shoes and brake are controlled hydraulically, by apparatus that is shown on the left-hand side of FIG. 11 and also in FIGS. 12 and 13. The mechanical drive for vertical movements will be described first.

The reciprocating vertical drive will now be described with reference to FIG. 2 and 11. As best seen in FIG. 11 the support arms 31 for the first shoe 24 have an extension bar 102 attached beneath them and which extends quite some distance downward to a point below the top of bulkhead 33*a* which is a part of the brake support frame 33. As seen in the side view of FIG. 2 this extension bar 102 is attached to the support arms 31 immediately adjacent to the upper shoe 24. In similar fashion the support arms 32*a*, 32*b* for the second shoe 25 are equipped with extension bars 101, 103, respectively, which extend below the top of bulkhead 33*a*.

A cam shaft 110 is eccentrically supported upon the right hand end portion of the main drive 50. The distance E1 between the center lines of the two shafts (see FIG. 11) is, in the present embodiment of the invention, one inch. As shown in FIG. 11 the cam shaft 110 is in its lowermost position, hence the distance E1 is purely vertically. Cam shaft 110 carries three circular cams which, reading from left to right in FIG. 11, are designated 116, 117, 118, respectively. The circular cams 116 and 118 are identical in size and both of them are mounted concentrically upon the cam shaft 110. Circular cam 117 is of larger diameter and is also concentrically mounted upon the cam shaft 110. The bottom surface of circular cam 117 extends below the bottom surfaces of circular cams 116, 118 by a distance E2 which, in the present embodiment of the invention, is 0.07 inch.

Vertically extending connecting rods 111, 112, 113 have their lower ends rotatably supported upon the cams or bearings 116, 117, 118, respectively, and are thereby driven in vertical reciprocating movements by the rotation of main drive shaft 50. As best seen in FIG. 11, the upper end of connecting rod 111 engages and supports the bottom end surface of extension bar 101; the upper end of connecting rod 112 engages and supports the bottom end of extension rod 102; and the upper end of connecting rod 113 engages and supports the bottom end of extension bar 103.

Thus, the rotation of cam shaft 110 driven by motor 85 through gear box 86 and main drive shaft 50 produces vertical reciprocating movements of the connecting rods 111, 112, 113, which in turn drive the support arms 31, 32 in reciprocating vertical movements together with their corresponding shoes 24, 25. The circular cams 116, 118 which are eccentrically mounted by a distane of one inch relative to the main drive shaft 50 therefore drive the lower shoe 25 in a reciprocating movement through a vertical distance of two inches. Because of the greater diameter of circular cam 117 the shoe 24 is driven in a vertical reciprocating movement through a distance of 2.14 inches. The additional seven percent travel distance of the upper shoe to which mold 23 is attached, accomplishes the negative stripping action within the mold as referred to previously.

Since the bottom end of each of the connecting rods moves in a circular pattern its upper end is continuously being twisted as well as being reciprocated in the vertical direction. The upper ends of the connecting rods are therefore supported by means of movable linkages from the bulkhead 33*a*. More specifically, a connecting link shaft 100 extends horizontally along the bulkhead and is supported from it by a set of four horizontal eyes 105. A first pair of links 107 (see FIG. 2) has one of its ends supported on the shsft 100 while the other end of the link pair is supported on a stub shaft 107*a* which passes through the upper end of connecting rod 111. See FIG. 11. In similar fashion the upper ends of connecting rods 112, 113 are supported from the shaft 100 by means of link pairs 108, 109, respectively.

Before describing the controls for the gripping and releasing action of the shoes and the brake, the structure of the device itself will be described. For that purpose reference is now made to drawing FIGS. 15 through 17, inclusive, where shoe 24 supported on arms 31 is shown.

Figure 15:
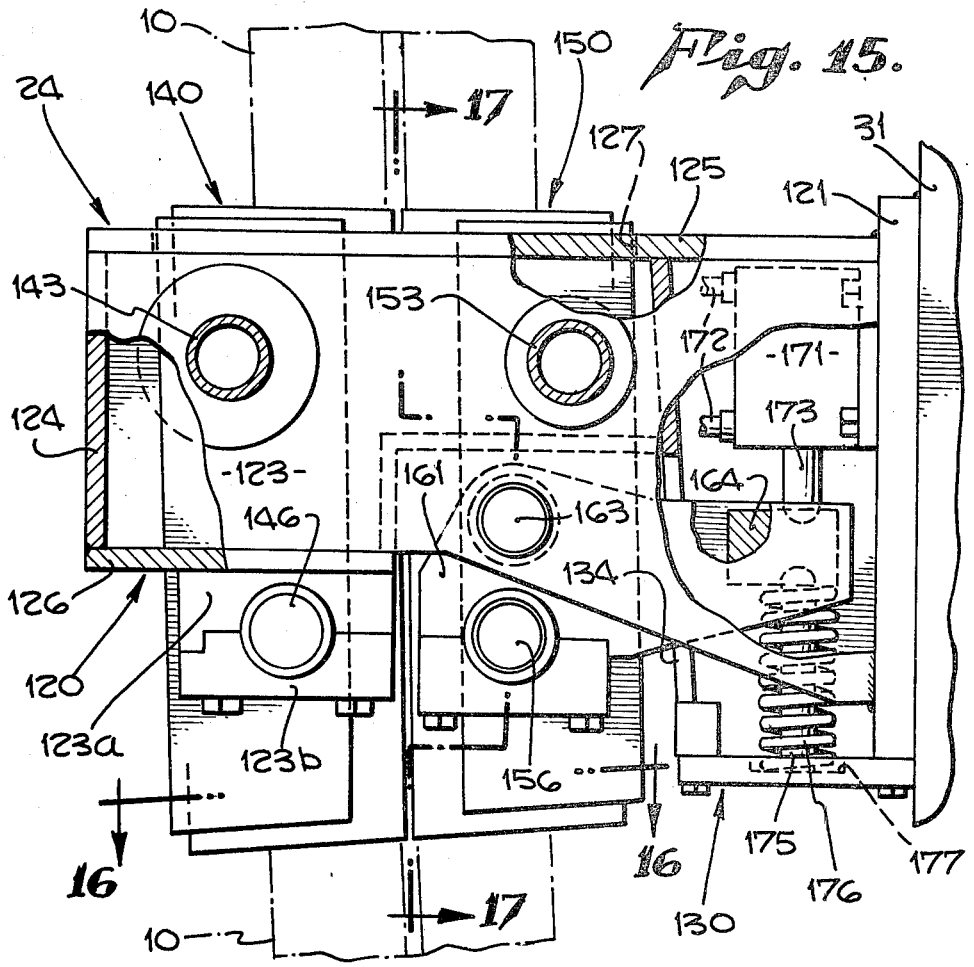
FIG. 15 is an elevation view, partially in cross-section, of one of the shoes with the billet extending through it.

A main housing 120 includes a vertical base plate 121 which is attached to the arms 31 and reciprocates vertically with them (FIG. 15). Side plates 122, 123 and top plate 125 are best seen in FIG. 17, which also shows a large vertical opening 127 through the housing. Outer end plate 124 and bottom plate 126 are seen in FIG. 15.

Main housing 120 is of sufficient size to surround not only the casting 10 but also an outer shoe half 140 that is relatively stationary and an inner shoe half 150 that is relatively movable. Each of the shoe halves is so constructed and arranged as to be cooled by water or some other cooling liquid that is circulated through it. Separate water inlet and water outlet tubes are coupled to each of the shoe halves, and all of these water tubes are also housed within the main housing 120, but are not illustrated in detail in the present drawings.

Figure 16:
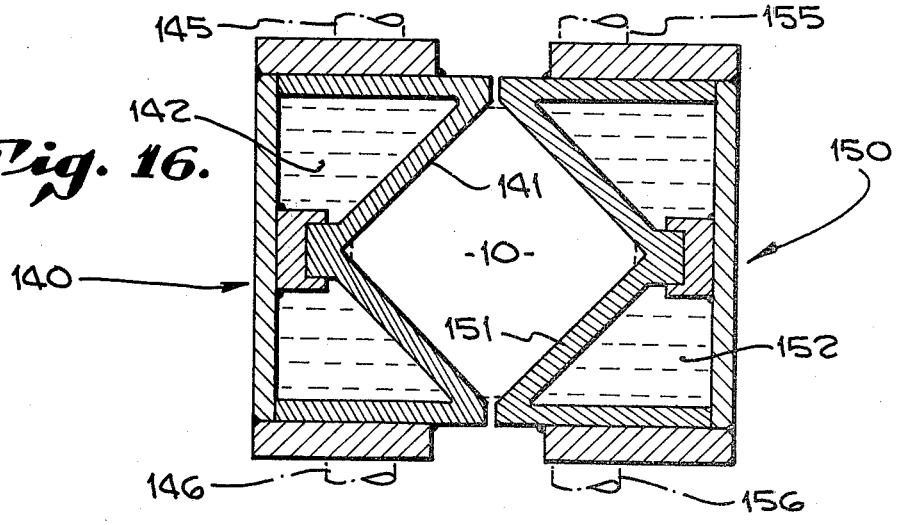
FIG. 16 is a horizontal cross-sectional view of the lower end of the shoe taken on line 16—16 of FIG. 15.

Reference is now made to FIG. 16 from which the construction of the shoe halves will be most readily understood. Outer shoe half 140 and inner shoe half 150 are substantially identical except that the outer shoe half 140 is convexly curved along its vertical axis while inner shoe half 150 is concavely curved, and ouer half 40 is also somewhat longer. Outer shoe half 140 includes V-shaped or L-shaped copper contact plates 141 while the inner shoe half 150 includes V-shaped or L-shaped copper contact plates 151. Each shoe half is substantially in the form of a rectangular box or trough within which the corresponding contact plate is supported. The shoe halves therefore contain respective interior chambers 142, 152 which are used for the circulation of cooling water. Each water chamber is equipped with both inlet and outlet tubes, but only the inlet tubes 143, 153 are shown in FIG. 15.

The contact plates 141, 151 of the two shoe halves are adapted to cooperatively engage substantially the full circumference of the casting 10, and along a substantial portion of its length. In the present embodiment of the invention the length of each of the contact plates is about 17 inches. Each flat surface of the contact plates, being adapted to fit the corresponding surface of the casting, has in the present embodiment a width of about 5½ inches.

The outer shoe half 140 has a pair of short pivot arms 145, 146 on its respective sides. See FIG. 16 where both are shown in dotted lines. The axis of these pivot arms is well below the vertical center of the shoe half, and specifically, about one-third of its length above its lower end. The main housing 120 near the outer end wall 124 has depending side wall portions 122*a*, 123*a* of which the latter is seen in FIG. 15. A separate wall piece 123*b* is bolted underneath, with these two wall pieces together forming a bearing for the short pivot arm 146. Therefore, outer shoe half 140 is pivotally supported from the main housing 120 along an axis that is transverse to the longitudinal axis of the casting 10, and is well below the vertical center of the shoe half.

The inner shoe half 150 is not supported directly from main housing 120 at all, but rather, is supported from an operating mechanism which may be selectively operated for opening or closing the shoe. Specifically, inner shoe half 150 has short pivot arms 155, 156 which are located similarly to pivot arms 145, 146, as shown in FIGS. 15 and 16.

The operating mechanism includes a pair of parallel arms 160, 161, each of which is essentially in the form of an L-shaped plate. See FIG. 15. The longer branch of each operating arm is horizontally disposed and terminates near the base plate 121, while the shorter branch is vertically disposed and extends downward to receive the corresponding short pivot arm 155 or 156 of the inner shoe half 150. Near the base plate 121 a bar 164 extends between the ends of the operating arms and supports them securely in their spaced relationship. At the junctures of their long and short branches each of the L-shaped operating arms is provided with a corresponding short pivot arm 162 or 163. These pivot arms are journaled in corresponding openings in respective side plates 122, 123 of the main housing 120. See FIGS. 15 and 17. Thus, operating arms 160, 161 are pivotally supported from the main housing, but inner shoe half 150 is not.

As previously noted, the short pivot arms 155, 156 of the inner shoe half 150 are pivotally supported from the lower portions of the short branches of the operating arms 160, 161, respectively. As in the case of the outer shoe half this pivot axis constitutes the only direct support for the inner shoe half. The pivot axis extends perpendicular to the longitudinal axis of the metal casting 10 and is located substantially below the longitudinal center of the inner shoe half. Specifically, it is located about one-third of the way from the bottom end of the inner shoe half as clearly seen in FIG. 15. It will therefore be seen that a rotating movement of the operating arms 160, 161, such as would be produced by vertical movement of the connecting bar 164, forces the lower ends of the operating arms towards or away from the outer shoe half, and will thereby produce a gripping or releasing action of the two shoe halves.

Inside the main housing 120 and adjacent to the base plate 121 there is an inner housing 130. This inner housing includes a bottom plate 133, respective side plates 131, 132, and at least a partial outer plate 134. The actuating mechanism which drive the operating arms 160, 161 is contained within this inner housing.

Thus a hydraulic cylinder 171 is fastened to the upper end of base plate 121 and has a pair of hydraulic control lines 172 coupled to it. A plunger 173 extends vertically downward from the cylinder. The lower end of plunger 173 permanently engages the cross-bar 164, being received in a recess therein. A compression spring 176 extends upward from the bottom plate 133 in alignment with the plunger 173. A vertical guide pin 175 is loosely received within the compression spring 176 to guide its movement. Spring 176 remains under compression at all times.

When hydraulic cylinder 171 is actuated it drives the operating arms and hence the compression spring downwardly, but only by a very small distance. The reason is that the opening and closing of the expansible shoe changes the distance between the shoe halves by a very small amount. For example, when upper shoe 24 is tightly gripping the billet 10 the contact pressure may be about 10 or 15 pounds per square inch, but when the gripping action is released the contact pressure may drop to about one pound per square inch. The change in the magnitude of the contact pressure is very significant but the physical movement of the inner shoe half 150 is relatively minute.

When hydraulic cylinder 171 is actuated in order to cause the shoe to grip the casting, each shoe half is pressed against the casting in a pivotal relationship therewith, because of the fact that it is supported from only a single pivotal axis. Outer shoe half 140 is supported directly from the main housing 120 on the pivot axis 145, 146. Inner shoe half 150 is supported only from the operating arms along the pivot axis 155, 156, but the operating arms in turn are pivotally supported from the main housing on the axis 162, 163. As previously noted, the operating arms are also supported from the housing by means of the actuating mechanism 171, 173, 164, 176.

It is also significant that the respective pivot axes upon which the shoe halves are supported are located beneath their vertical centers. As a result, the gripping pressure at the top of the shoe tends to be somewhat less than the gripping pressure at the bottom. The molten interior of the casting and the high temperature of its thin outer wall results in some flexibility of movement, hence to some extent the shape of the casting tends to adapt to the configuration of the shoe while at the same time the configuration of the shoe tends to adapt to the shape of the casting.

The operation of the controls for the gripping and release action of the shoes and brake will now be described. For that purpose reference is made to FIGS. 11 to 13, inclusive.

The timing of the operations is such that the gripping actions of the upper shoe 24 and the lower shoe 25 occur at precisely the same time, and they are also released at precisely the same time. Because of the difference in elevations of the two shoes however, a higher level of pressure is applied to the hydraulic cylinder of shoe 25 in order to produce a tighter gripping action. It is convenient to use separate control valves for the hydraulic cylinders of the shoes 24 and 25, even though the timing is identical.

Thus as shown in FIG. 11 the left hand end of main drive shaft 50 carries a pair of identical eccentric cams 184, 185 which control the operations of the shoes 24, 25, respectively. These cams are provided with cam followers 184*a*, 185*a*, respectively, and although the apparatus is not shown in complete detail, the operation is such that the cam followers directly controls the pumping of fluid through the hydraulic lines that supply energy to the hydraulic cylinders of the shoes. Pressure relief valves, not shown in the present drawings, limit the hydraulic pressure supplied to the shoes.

Another eccentric cam 186 equipped with cam follower 186*a* controls the operation of the brake 26. As explained earlier the operation in general is that the brake 26 is gripping while the shoes 24 and 25 are released, and vice versa. More specifically, however, it is necessary to ensure a slight overlap of the gripping actions so that there is no time gap in the mechanical support that is provided to the casting. Thus as shown in FIG. 12 the gripping action of the brake is turned on at about five degrees of rotation before the gripping action of the shoes is released. And as shown in FIG. 13 the "on" pressure is initially applied to the shoes about five degrees of revolution prior to the time when the brake pressure is entirely released.

FIG. 10 illustrates V-shaped rollers 190 which support the billet 10 in its horizontal trajectory.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In the art of continuous casting of metals, the method comprising the steps of:

continuously pouring metal into a vertically reciprocating mold so as to form a continuous metal casting which then moves downward underneath the mold;

placing two expansible metal shoes about the casting at two corresponding points along its length;

continuously supplying liquid coolant in heat-conductive relationship to said shoes so as to cool the casting;

each time the reciprocating mold moves upward, squeezing one of the shoes against the casting and then holding it in place so that it will act as a brake to inhibit longitudinal movement of the casting;

each time that the reciprocating mold moves downward, squeezing the other shoe against the casting so as to firmly grasp it, while concurrently releasing most but not all of the pressure with which said one shoe grips the casting, so that the casting may then slide within said one shoe; and thereafter driving said other shoe downward in at least approximate synchronism with the movement of the mold, so as to drive the casting downward.

2. In the art of the continuous casting of steel wherein molten steel is continuously poured into a vertically aligned mold, and the mold is continuously reciprocated in a vertical direction, the method of supporting the initially formed shell of the casting against breakout while also cooling both the shell and its molten interior, comprising the steps of:

selecting an expansible metal shoe having at least two metal contact plates adapted to engage corresponding portions of the periphery of the casting;

positioning the expansible shoe immediately beneath the mold and supporting it from the mold for vertical reciprocation therewith;

whenever the mold is moving downward, pressing the contact plates together so as to tightly grip the initially formed shell of the casting in order to drive the casting downward;

when the mold reaches the lower limit of its movement, gripping the casting at a location beneath the shoe with other means and thereby holding it in place while the mold moves upwardly;

whenever the mold is moving upward, releasing most but not all of the pressure on the contact plates so that the casting may be moved longitudinally through the shoe; and continuously cooling the contact plates so as to continuously withdraw heat from the casting;

the operation being such that when the mold is moving downward and the shoe grips the casting tightly, heat is removed at a relatively rapid rate, and when the mold is moving upward and the shoe grips the casting lightly heat is then removed from the casting at a lower rate.

3. In the art of supporting and cooling a continuous metal casting while concurrently withdrawing it from the mold, the method comprising the steps of:

selecting an expansible shoe having at least two relatively movable metal contact plates;

placing the shoe about the casting with the contact surface of each of said contact plates fully engaging the surface of the casting in constant contact therewith;

continuously circulating liquid coolant in heat-conductive relationship with said contact plates;

periodically applying a relatively high level of contact pressure to the plates so as to tightly grip the casting;

when the casting is thus tightly gripped, advancing the shoe along the pathway of the casting so as to thereby forcibly drive the casting in the withdrawal direction;

after each advancing movement of the shoe, grasping the casting with other means so as to support it independently of the shoe; and concurrently releasing most but not all of the contact pressure of the plates and retracting the shoe so that the contact plates slide along the casting in the direction towards the mold;

whereby the shoe continuously supports the shell of the casting against break-out, provides a driving means for withdrawing the casting from the mold, and also continuously cools the casting during both advancing and retracting movements of the shoe.

4. The method of claim 3 wherein said shoe is positioned immediately underneath the mold, the mold is driven in a reciprocating movement, and said shoe is advanced and retracted in synchronism with the reciprocating movement of the mold.

5. The method of claim 3 wherein two such shoes are positioned at corresponding points along the casting and are advanced and retracted in synchronism.

6. In the art of the continuous casting of steel wherein molten steel is continuously poured into a vertically aligned mold, and the mold is continuously reciprocated in a vertical direction, the method of supporting the initially formed shell of the casting and its molten interior, comprising the steps of:

selecting an expansible shoe having at least two metal contact plates adapted to engage corresponding portions of the periphery of the casting;

positioning the expansible shoe immediately beneath the mold in vertical alignment therewith;

securing one contact plate of the shoe to the corresponding side of the mold so that said one contact plate is fixedly supported both vertically and horizontally relative to the mold and the entire shoe will reciprocate vertically with the mold;

moving the mold downward, and concurrently pressing the other contact plate of the shoe with a relatively high level of pressure towards said one contact plate so as to tightly grip the initially formed shell of the casting therebetween;

moving the mold upward, while restraining the casting against upward movement by other means, and concurrently releasing most but not all of the pressure on said other contact plate so that the shoe will move upward in a sliding relationship upon the casting; and continuously cooling the contact plates so as to continuously withdraw heat from the casting during both downward and upward movements of the mold.

7. The method of claim 6 wherein the casting is led through an arcuately curved path, and said one contact plate of the shoe is positioned so as to support the outer curved surface of the casting.

8. In the art of the continuous casting of steel wherein molten steel is continuously poured into a vertically aligned mold, and the mold is continuously reciprocated in a vertical direction, the method of supporting the initially formed shell of the casting against breakout while also cooling both the shell and its molten interior, comprising the steps of:

selecting two expansible shoes each having at least two metal contact plates adapted to engage corresponding portions of the periphery of the casting;

positioning the first shoe immediately beneath the mold and in vertical alignment therewith, with one contact plate of said first shoe being fixedly supported from the corresponding side of the mold;

positioning the second shoe beneath the first shoe and aligned therewith along an arcuate path that the casting is to follow, said one contact plate of said first shoe and one contact plate of said second shoe being so positioned as to support the outer curved surface of the casting;

each time the mold and first shoe move downward, concurrently pressing the other contact plate of the first shoe tightly against the casting so as to firmly grasp it;

each time the mold moves downward, also driving the second shoe downward at approximately the same speed as the mold, and concurrently pressing the other contact plate of the second shoe against the casting at a significantly higher pressure level than is applied to said other contact plate of the first shoe;

when the downward stroke of both shoes is completed, grasping the casting at a location below the second shoe with other means so as to hold it in position;

then raising the mold and both shoes, and concurrently releasing most but not all of the pressure on said other contact plates of both shoes so that both shoes will slide upward on the surface of the casting; and continuously cooling the contact plates of both shoes so as to continuously withdraw heat from the casting during both downward and upward movements of the shoes.

9. In the art of continuous casting of steel by pouring molten metal into a vertically aligned mold to produce a casting having a solidified shell and an interior column of molten metal, the method of guiding, supporting, driving and cooling the casting, comprising the steps of:

selecting three expansible shoes each having a pair of metal contact plates adapted to grip corresponding sides of the casting;

placing the shoes in sequentially spaced positions below the mold and so arranged as to, in cooperation with the mold, define a desired path of downward movement of the casting;

driving the mold and the first and second shoes in a substantially uniform and substantially vertical reciprocating movement;

each time that the mold and the first and second shoes move downward, contracting the plates of the first and second shoes so as to tightly grip the casting, while concurrently expanding the plates of the third shoe so that it grips the casting only loosely, the first and second shoes thereby driving the casting downward and the casting sliding downward within the third shoe;

each time that the mold and the first and second shoes move upward, contracting the plates of the third shoe so that it tightly grips the casting and acts as a brake, while concurrently releasing most but not all of the pressure on the plates of the first and second shoes so that they grip the casting only loosely and slide upward upon it;

each time that each shoe is contracted, causing it to grip the casting with an amount of pressure that is sufficient to counteract the ferrostatic pressure generated at the elevation of that shoe by the molten metal within the shell of the casting; and continuously supplying cooling liquid to the plates of all of the shoes so that heat is withdrawn from the casting by each of the shoe plates during both downward and upward movements of the mold.

10. The method of claim 9 wherein the shoes are so arranged as to guide the casting along an arcuately curved path.

* * * * *